United States Patent [19]

Hamano

[11] Patent Number: 5,001,309

[45] Date of Patent: Mar. 19, 1991

[54] IGNITION DISTRIBUTOR FOR INTERNAL COMBUSTION ENGINE

[75] Inventor: Isao Hamano, Hyogo, Japan

[73] Assignee: Mitsubishi Denki Kabushiki Kaisha, Tokyo, Japan

[21] Appl. No.: 450,506

[22] Filed: Dec. 14, 1989

[30] Foreign Application Priority Data

Dec. 14, 1988 [JP] Japan ..... 63-161282

[51] Int. Cl.[5] ..... H01H 19/00; F02P 7/00

[52] U.S. Cl. ..... 200/19 DR; 200/19 DC

[58] Field of Search ..... 200/19 R, 19 DC, 19 DR

[56] References Cited

U.S. PATENT DOCUMENTS

| | | | |
|---|---|---|---|
| 3,949,721 | 4/1976 | Hori et al. | 123/146.5 A |
| 4,135,066 | 1/1979 | Yamanaka et al. | 200/19 R |
| 4,345,120 | 8/1982 | Sawada et al. | 200/19 DR X |
| 4,381,429 | 4/1983 | Nakayama et al. | 200/19 R |
| 4,468,543 | 8/1984 | Sone et al. | 200/19 DR |

FOREIGN PATENT DOCUMENTS

| | | | |
|---|---|---|---|
| 0044895 | 7/1980 | European Pat. Off. . | |
| 0176208 | 4/1986 | European Pat. Off. . | |
| 2812270 | 9/1978 | Fed. Rep. of Germany . | |
| 2949573 | 6/1980 | Fed. Rep. of Germany . | |
| 3522544 | 1/1986 | Fed. Rep. of Germany . | |
| 3807791 | 9/1988 | Fed. Rep. of Germany . | |
| 2256324 | 7/1975 | France . | |
| 51-38852 | 10/1976 | Japan . | |
| 545139 | 1/1979 | Japan | 200/19 DR |

OTHER PUBLICATIONS

Patent Abstracts of Japan, vol. 9, No. 117 (M-381) [1840], May 22, 1985; JP-A-60 3483.

Patent Abstracts of Japan, vol. 7, No. 41 (M-194) [1186], Feb. 18, 1983; JP-A-67 191462.

Patent Abstracts of Japan, vol. 6, No. 199 (M-162) [1077], Oct. 8, 1982; JP-A-57 105 561.

*Primary Examiner*—J. R. Scott

*Attorney, Agent, or Firm*—Sughrue, Mion, Zinn, Macpeak & Seas

[57] ABSTRACT

An ignition distributor for an internal combustion engine comprises a distributing rotor which rotates about a rotational axis in synchronism with the internal combustion engine and a distributing cap adapted to enclose the distributing rotor. The distributing rotor has a rotor electrode mounted away from the rotational axis. The rotor electrode has a tip end which extends along a circular path that the rotor electrode describes when it rotates. The distributing cap is provided with side electrodes disposed concentrically with the distributing rotor and oppositely to the tip end with a predetermined gap between the side electrodes and the tip end. The tip end is covered by the dielectric member only in part in a direction transversely of the circular path. The tip end may be provided with a recess extending along the circular path for receiving the dielectric member therein.

2 Claims, 2 Drawing Sheets

IGNITION DISTRIBUTOR FOR INTERNAL COMBUSTION ENGINE

BACKGROUND OF THE INVENTION

1. Field of the Invention

The present invention relates to an ignition distributor for an internal combustion engine and more particularly for minimizing radiation of radio-noise from the engine.

2. Prior Art

FIG. 3 shows the essential part of a prior art ignition distributor for an internal combustion engine disclosed by Japanese Patent Publication No. 61-38351. At the center of the bottom of a distributing rotor 1, a recess 1*a* is formed for fitting the end portion of a shaft S which rotates in synchronism with the internal combustion engine. The top of a rotor electrode 2 is covered with a dielectric plate 4 except the portion which a center carbon 3 abuts. The underside of the rotor electrode 2 is covered by a dielectric plate 5. The rotor electrode 2 and the dielectric plates 4, 5 are integrally secured to the distributing rotor 1 by means of a rivet 6, and rotate about an axis A of the shaft S. As many side electrodes 7 as there are cylinders are disposed circumferentially with a gap of a predetermined size between the tip end 2*a* of the rotor electrode 2, and are held in a unitary construction together with the center carbon 3 by means of an insulating distributing cap.

With the above-described construction, when the distributing rotor 1 is driven into rotation by the rotation of the internal combustion engine, a high voltage generated by an ignition coil (not shown) is distributed to a corresponding ignition plug through the rotor electrode 2 and the side electrode 7. At this time, a spark discharge is produced due to the gap between the rotor electrode 2 and the side electrode 7, being a source of radio-noise. The dielectric plates 4, 5 serve to minimize the radio-noise.

FIG. 4 shows another prior art ignition distributor in which silicone varnish 40, for example, is applied as a dielectric material over the entire surface of the tip end 2*a* of the rotor electrode 2.

Although the above-described prior art ignition distributors play a role in minimizing radio-noise, the distributor shown in FIG. 3 suffers from a problem in that the increased number of parts and a time-taking consuming assembly process make the distributor more expensive. The distributor shown in FIG. 4 suffers from a drawback in that the surface to which the silicone varnish 40 is applied tends to be gradually worn out thus causing a non-uniform discharge over the entire surface of the tip 2*a* of the rotor electrode opposite to the side electrode 7. The non-uniform discharge causes the distributor to exhibit unstable discharge characteristics and increased radio-noise.

SUMMARY OF THE INVENTION

The present invention was made to overcome the aforementioned drawbacks, and an object of the invention is to provide an ignition distributor for an internal combustion engine in which radio-noise is sufficiently suppressed with a high durability and at a low cost.

An ignition distributor for an internal combustion engine according to the present invention comprises a distributing rotor electrode having a tip end; and a distributing cap for enclosing the distributing rotor, and having side electrodes disposed circumferentially relative to the rotational axis A of the distributing rotor and oppositely to the tip end of the rotor electrode. The tip end is provided with an arcuate dielectric member thereon disposed on only part of said tip end opposite to said side electrode, whereby electrical discharge is performed between a portion of the tip end which is not covered by the dielectric member and the side electrode.

BRIEF DESCRIPTION OF THE DRAWINGS

Features and other objects of the invention will be more apparent from the description of preferred embodiments with reference to the accompanying drawings in which.

DESCRIPTION OF PREFERRED EMBODIMENTS

Operation

The distribution of electric current to the respective side electrode 7 is performed in a manner similar to that in the prior art distributor. The provision of the dielectric member 8 causes the charge to be accumulated on the surface of the dielectric member 8 during excursion of the distributing rotor 1 rotating from one side electrode 7 to the next side electrode 7. When the tip end 2*a* faces the side electrode 7 and the discharge occurs between the exposed metal surface or discharge surface of the tip end 2*a* and the side electrode 7 opposing the discharge surface, electrons accumulated on the surface of the dielectric member 8 tend to move to a discharge surface 2*a* to facilitate the discharge. In this manner, a stable discharge is performed with good stability thus minimizing the radiation of the radio noise.

Embodiment

Figure 1:
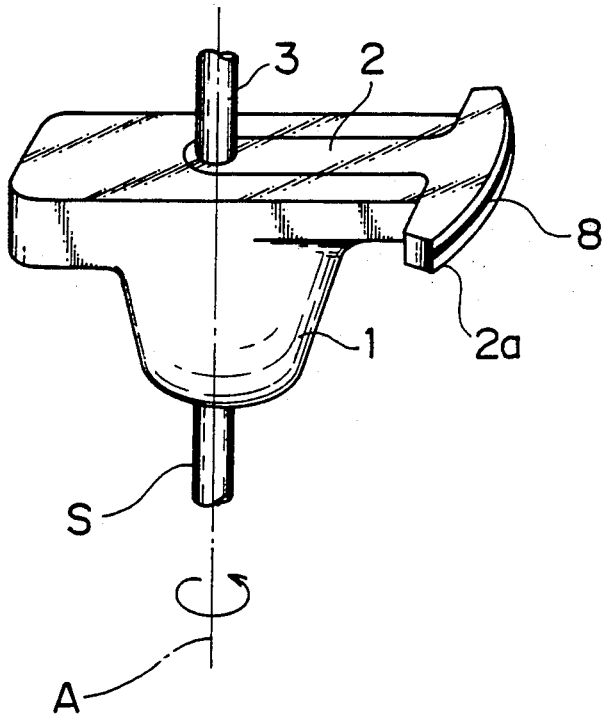
FIG. 1 is a perspective view of a particular detail of an ignition distributor for an internal combustion engine according to the present invention.
Figure 2A:
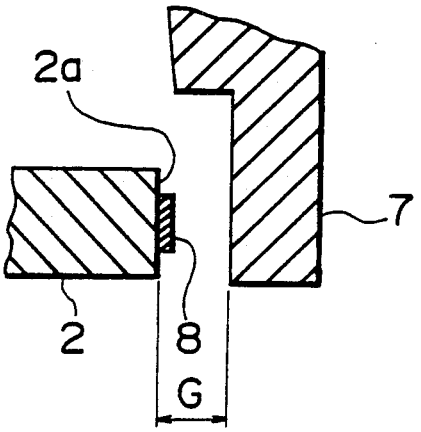
FIG. 2A shows a fragmentary cross-sectional view of the embodiment in FIG. 1 and a positional relation of the discharge surface relative to the side electrode.
Figure 2B:
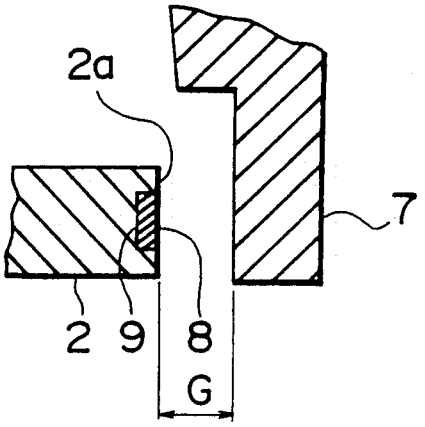
FIG. 2B shows a fragmentary cross-sectional view of another embodiment in which the discharge surface is provided with a recess for receiving a dielectric material, and a positional relation of the discharge surface relative to the side electrode.
Figure 3:
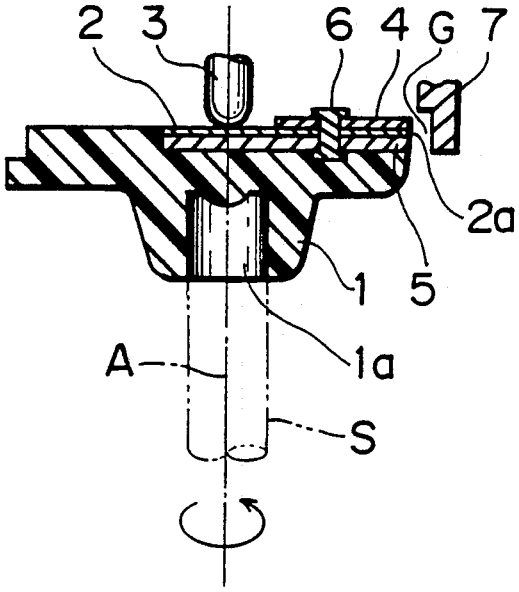
FIG. 3 PRIOR ART
FIG. 3 is a cross-sectional side view of an essential part of a prior art ignition distributor.
Figure 4:
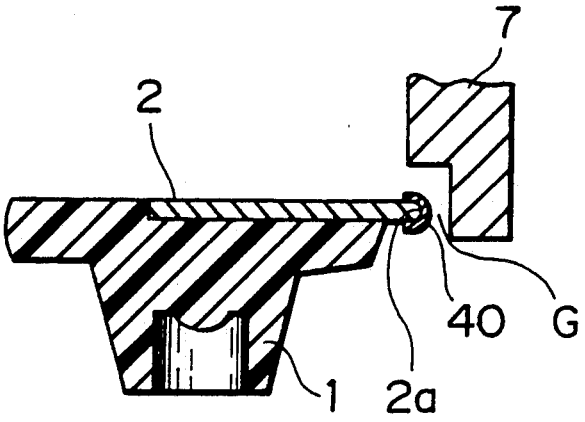
FIG. 4 PRIOR ART
FIG. 4 is a cross-sectional side view of another prior art ignition distributor.

An embodiment of the invention will now be described with reference to the drawings. FIG. 1 is a perspective view of a particular detail of an ignition distributor for an internal combustion engine according to the present invention. FIG. 2A shows a fragmentary cross-sectional view of the embodiment in FIG. 1 and a positional relation of the discharge surface 2*a* relative to a side electrode 7. Referring to FIGS. 1–2, a dielectric member 8 made of, for example, alumina is flame-sprayed to the middle portion of the tip end 2*a* of a rotor electrode 2. The dielectric member 8 may also be made of other dielectric materials such as non-organic materials including SiC and SiO2 or heat-resistive resins or a mixture of these materials. As is apparent from FIGS. 1–2, the dielectric member 8 is provided on the arcuate surface of the tip end 2*a* configured to a circular path that the surface 2describes when the rotor electrode 2 rotates about the axis A. The dielectric member 8 may be provided at either both edges or one edge of the surface of the tip end 2*a* opposing the side electrode 7. The method of depositing of the dielectric material is not limited to the flame spraying method but may include various deposition techniques, coating, and so on. The tip end 2*a* may be provided with an arcuate recess or groove 1 in the surface opposite to the side electrode 7, as shown in FIG. 2B, in which the dielectric material is applied. The other elements have the same references as those in the described prior art ignition distributor; therefore the duplicate description is omitted.

Further, it should be noted that the dielectric member 8 is not provided over the entire surface of the tip end 2*a* but only part of the surface between the two edges thereof as shown in FIG. 1. This arrangement prevents damage to the dielectric member 8, thereby providing high reliability.

The embodiment described above is only exemplary and modifications may be made without departing from the scope of the invention.

What is claimed is:

1. An ignition distributor for an internal combustion engine comprising:

a distributing rotor which rotates about a rotational axis in synchronism with the internal combustion engine and which has a rotor electode mounted away from the rotational axis, said rotor electrode having a tip end which extends along a circular path that the rotor electrode describes when the rotor electrode rotates about the rotational axis, said tip end having upper and lower edges; and distributor cap electrodes circumferentially arranged relative to the rotational axis of said distributor rotor and oppositely to said tip end with a predetermined gap therebetween; wherein said tip end is provided with a single, circumferentially extending dielectric member thereon, and said tip end being covered by said dielectric member only in a middle portion thereof such that portions of said tip end between said middle portion and said upper and lower edges, respectively, are devoid of said dielectric member, whereby electrical discharge takes place between a corresponding one of said distributor cap electrodes and said portions of said tip end which are devoid of said dielectric member.

2. An ignition distributor for an internal combustion engine according to claim 1, wherein said tip end is provided with a single recess which extends along said circular path at said middle portion, said recess receiving said dielectric member therein.

* * * * *